US011779980B2

(12) United States Patent
Bazzaro et al.

(10) Patent No.: US 11,779,980 B2
(45) Date of Patent: Oct. 10, 2023

(54) PROCESS FOR COLD ROLLING AN ALUMINUM PRODUCT AND RELATED COLD ROLLING PLANT

(71) Applicant: DANIELI & C. OFFICINE MECCANICHE S.p.A., Buttrio (IT)

(72) Inventors: Gianluca Bazzaro, Codroipo (IT); Claudio Sepulveres, Dosson di Casier (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 178 days.

(21) Appl. No.: 17/601,688

(22) PCT Filed: Apr. 8, 2020

(86) PCT No.: PCT/IB2020/053337
§ 371 (c)(1),
(2) Date: Oct. 5, 2021

(87) PCT Pub. No.: WO2020/208535
PCT Pub. Date: Oct. 15, 2020

(65) Prior Publication Data

US 2022/0184680 A1 Jun. 16, 2022

(30) Foreign Application Priority Data

Apr. 9, 2019 (IT) ..... 102019000005442

(51) Int. Cl.
*B21B 45/02* (2006.01)
*B21B 1/28* (2006.01)
(Continued)

(52) U.S. Cl.
CPC ..... *B21B 45/0251* (2013.01); *B21B 1/28* (2013.01); *B21B 27/10* (2013.01); *B21B 2001/221* (2013.01); *B21B 2003/001* (2013.01); *B21B 2275/04* (2013.01); *B21B 2275/06* (2013.01)

(58) Field of Classification Search
CPC ..... B21B 2275/06; B21B 1/28; B21B 1/32; B21B 1/36; B21B 45/0209;
(Continued)

(56) References Cited

U.S. PATENT DOCUMENTS 4,324,122 A * 4/1982 Urban ..... B21B 27/055 72/201
9,815,101 B2 * 11/2017 Krimpelstatter ..... B21B 15/005
(Continued)

FOREIGN PATENT DOCUMENTS

CN 101084074 A 12/2007
DE 10143407 A1 3/2003
(Continued)

OTHER PUBLICATIONS

Patent Cooperation Treaty, International Search and Written Opinion of the International Searching Authority for International Application No. PCT/IB2020/053337, dated Sep. 17, 2020, 13 pages.
(Continued)

*Primary Examiner* — Bobby Yeonjin Kim
(74) *Attorney, Agent, or Firm* — STETINA BRUNDA GARRED AND BRUCKER

(57) ABSTRACT

A process of cold rolling an aluminum product, e.g. a strip, which crosses at least one rolling stand, wherein a lubricant is applied to the strip close to said at least one rolling stand by means of a plurality of applying means, said lubricant comprising an emulsion of oil and water. A related rolling plant is also described.

11 Claims, 4 Drawing Sheets

(51) Int. Cl.

| | |
|---|---|
| ***B21B 27/10*** | (2006.01) |
| *B21B 1/22* | (2006.01) |
| *B21B 3/00* | (2006.01) |

(58) Field of Classification Search
CPC ..... B21B 45/0215; B21B 45/0218; B21B 45/0233; B21B 45/0251; B21B 45/0239; B21B 45/0242; B21B 45/0245; B21B 45/0248; B21B 2027/103; B21B 27/10
See application file for complete search history.

(56) References Cited

U.S. PATENT DOCUMENTS

| | | | | |
|---|---|---|---|---|
| 2014/0238093 | A1* | 8/2014 | Krimpelstatter | B21B 1/36 72/41 |
| 2016/0318080 | A1* | 11/2016 | Moretto | B21B 1/22 |
| 2022/0143662 | A1* | 5/2022 | Bergmann | B21B 45/0215 |

FOREIGN PATENT DOCUMENTS

| | | | |
|---|---|---|---|
| EP | 1829625 | A1 | 9/2007 |
| JP | H07132314 | A | 5/1995 |
| JP | 2006224141 | A | 8/2006 |
| WO | 9951369 | A1 | 10/1999 |

OTHER PUBLICATIONS

Yamamoto et al., Development of Forward Slip Ratio Control in Tandem Cold Rolling, 1987, p. 1358-1365.

* cited by examiner

PROCESS FOR COLD ROLLING AN ALUMINUM PRODUCT AND RELATED COLD ROLLING PLANT

CROSS-REFERENCE TO RELATED APPLICATIONS

This application claims priority to PCT International Application No. PCT/IB2020/053337 filed on Apr. 8, 2020, which application claims priority to Italian Patent Application No. 102019000005442 filed on Apr. 9, 2019, the disclosures of which are expressly incorporated herein by reference.

STATEMENT RE: FEDERALLY SPONSORED RESEARCH/DEVELOPMENT

Not applicable.

BACKGROUND OF THE INVENTION

Field of the Invention

The present invention relates to a cold rolling process specifically designed to roll products made of aluminum, or aluminum alloys, in particular strips, and to a related cold rolling plant.

Background Art

Friction is one of the key parameters in the plastic deformation processes of metal products. Lubrication plays an important role in the final aspect of the metal surface, especially in cold processing: in particular in the case of cold rolling products made of aluminum or alloys thereof, such as strips for example.

Currently, a lubricant widely used in industrial aluminum cold rolling mills is kerosene, which avoids leaving marks on the surfaces of the rolled strips which could affect the surface quality thereof. On the other hand, managing kerosene is challenging and dangerous, firstly due to the risk of fire and for the health of the operators. Kerosene must also be filtered to separate the aluminum powder and the debris originating from the rolling process, and filtration is difficult and costly.

Therefore, the drawbacks of kerosene mainly include:

- the significant risk of fire and the related social, insurance costs and costs for interrupting production;
- the reduced ability to remove the heat generated by the plastic deformation;
- the intrinsic toxicity (given that it is a petroleum by-product);
- the complex management thereof also outside the rolling stand (it is to be transported, filtered and distilled).

More in detail, the use of kerosene implies:

- using a costly $CO_2$ fire-prevention system which implies the removal of the $CO_2$ from the work area for the safety of the operator;
- obliging the operators close to the machine to always carry an oxygen cylinder, since the $CO_2$ system would saturate the atmosphere surrounding the machine in case of fire;
- the presence of vapors and aerosols which have a negative impact on human health and the environment;
- high costs of the lubricant itself, considering that the cost of kerosene today exceeds €1 per liter, and on average a rolling mill consumes an amount of kerosene of the order of several hundreds of thousands of liters a year.

It becomes of crucial importance in this scenario to rethink and redesign the technology for cold rolling products made of aluminum in order to obtain a safe technology that respects the environment and has curbed costs.

Moreover, in the processes for cold rolling aluminum strips it is not always possible to ensure the integrity of the thin film of lubricant (a few hundreds of a millimeter) in the rolling compartment, which serves to prevent the direct contact between the working rolls and the material from generating surface defects. One of these processes and the related plant are described in JPH07132314A and correspond to the preamble of claims 1 and 5, respectively.

Therefore, the need is felt to make an innovative process and related plant which allow overcoming the aforesaid drawbacks.

SUMMARY OF THE INVENTION

It is a first object of the present invention to provide a rolling process of products made of aluminum, or alloys thereof, in particular strips, which allows more efficient lubricating, with increased ability to remove the heat generated by the plastic deformation, increased safety of the work environment and a simplified management of the lubricant also after the rolling operation.

It is another object of the invention to provide a process for rolling products made of aluminum, or alloys thereof, which always ensures the integrity of the thin film of lubricant in the rolling compartment, thus avoiding the direct contact between the working rolls and the aluminum product.

It is a further object of the invention to provide a related rolling plant which allows a more efficient rolling of the products made of aluminum, or alloys thereof.

Therefore, the present invention aims at achieving at least one of the above-mentioned objects by providing a process of cold rolling a product made of aluminum, or alloys thereof, which crosses at least one rolling stand, wherein a lubricant is applied to the product close to said at least one rolling stand by means of a plurality of first applying means, said lubricant comprising an emulsion of oil and water, and wherein being $\Delta v = v_s - v_r$ the difference between the feeding speed $v_s$ of the rolled product, measured at the output of the at least one rolling stand, and the peripheral speed $v_r$ of the working rolls of said at least one rolling stand, measured during the rolling operation, and being $\Delta v_0 = v_{s0} - v_{r0}$ the design value of said difference, each time the relation $[(\Delta v * v_{r0})/(v_r * \Delta v_0)] - 1 < L$, where L is equal to a value between 0,0005 and 0,002, is not met, an application of only oil to the aluminum product is provided, upstream of said at least one rolling stand considering the product feeding direction, by means of a plurality of second applying means, until said relation is met again.

A second aspect of the present invention includes a plant for rolling products made of aluminum, or alloys thereof, which is adapted to perform the aforesaid rolling process and comprises:

- at least one rolling stand;
- a plurality of first applying means arranged in proximity of said at least one rolling stand and adapted to apply an emulsion of oil and water on the product;

and wherein there are provided first sensors for detecting first data, said first data being values of the feeding speed $v_s$ of the rolled product exiting the at least one rolling stand;

second sensors for detecting second data, said second data being values of the peripheral speed $v_r$ of the working rolls of said at least one rolling stand;

a plurality of second applying means arranged in proximity of said at least one rolling stand and adapted to inject only oil on the product;

a control system adapted to:

receive said first data and said second data, calculate the difference $\Delta v = v_s - v_r$, verify if the relation $[(\Delta v * v_{r0})/(v_r * \Delta v_0)] - 1 < L$ is met, $\Delta v_0 = v_{s0} - v_{r0}$ being the design value of said difference and L being equal to a value between 0,0005 and 0.002, and, if said relation is not met, actuate said plurality of second applying means.

The solution of the invention advantageously has significant advantages, while completely avoiding the risk of fire and drastically reducing the complexity in managing the lubricant. The ability of the water-based emulsion to remove the heat is more than double with respect to kerosene and, therefore, the required flow rates are less, productivity being equal.

Other advantages of the solution of the invention comprise:

using a more affordable lubricant;

using a water-based emulsion with a greater lubricating power compared to the traditional technologies, with subsequent improvement of the rolling processes and of the quality of the rolled aluminum product;

eliminating the surface marks on the aluminum, that is a quality problem occurring following the rolling process which is well known in the production of aluminum products, such as strips;

increasing the cooling ability which allows the rolling operation at higher speeds, thus improving the productivity of the rolling mill;

improving the productivity of the rolling mill, while eliminating the risk of fires (on average two fires a year);

requiring no costly $CO_2$ fire-prevention system;

requiring no fume distillation device for the operation of the rolling mill;

increasing compactness of the plant layout.

Considering also the reduced costs associated with the insurance, maintenance and increased use factor due to the elimination of the risk of fire, a reduction of the operating expenses of 10% can be estimated, when compared with the use of kerosene.

Moreover, this technology based on the water-based emulsion can be implemented in existing operating plants with minimal modifications correlated only with changing the filter unit in the fume exhaust system, bypassing the distiller, and with the improvement of the product drying system, if required. The rest of the plant can remain unvaried.

The invention advantageously includes a closed-loop control system which, by measuring the forward slip, i.e. the difference between the speed of the rolled strip, measured at the output of the at least one rolling stand, and the peripheral speed of the working rolls, measured during the rolling, determines whether oil is to be added on the product being rolled and, if affirmative, actuates the application of only oil on the product, upstream of the rolling compartment considering the feeding direction of the product itself. This dynamic correction of the amount of lubricant applied to the surface of the strip, immediately upstream of each rolling stand, always ensures the integrity of the thin film of lubricant in the rolling compartment, thus avoiding the direct contact between the working rolls and the aluminum product.

The dependent claims describe preferred embodiments of the invention.

BRIEF DESCRIPTION OF THE FIGURES

Further features and advantages of the invention will become more apparent in light of the detailed description of preferred, but not exclusive, embodiments of a rolling process and of a related plant, disclosed by way of non-limiting examples, with the aid of the accompanying drawings in which.

The same reference numerals in the Figures identify the same elements or components.

DETAILED DESCRIPTION OF PREFERRED EMBODIMENTS OF THE INVENTION

Figure 1:
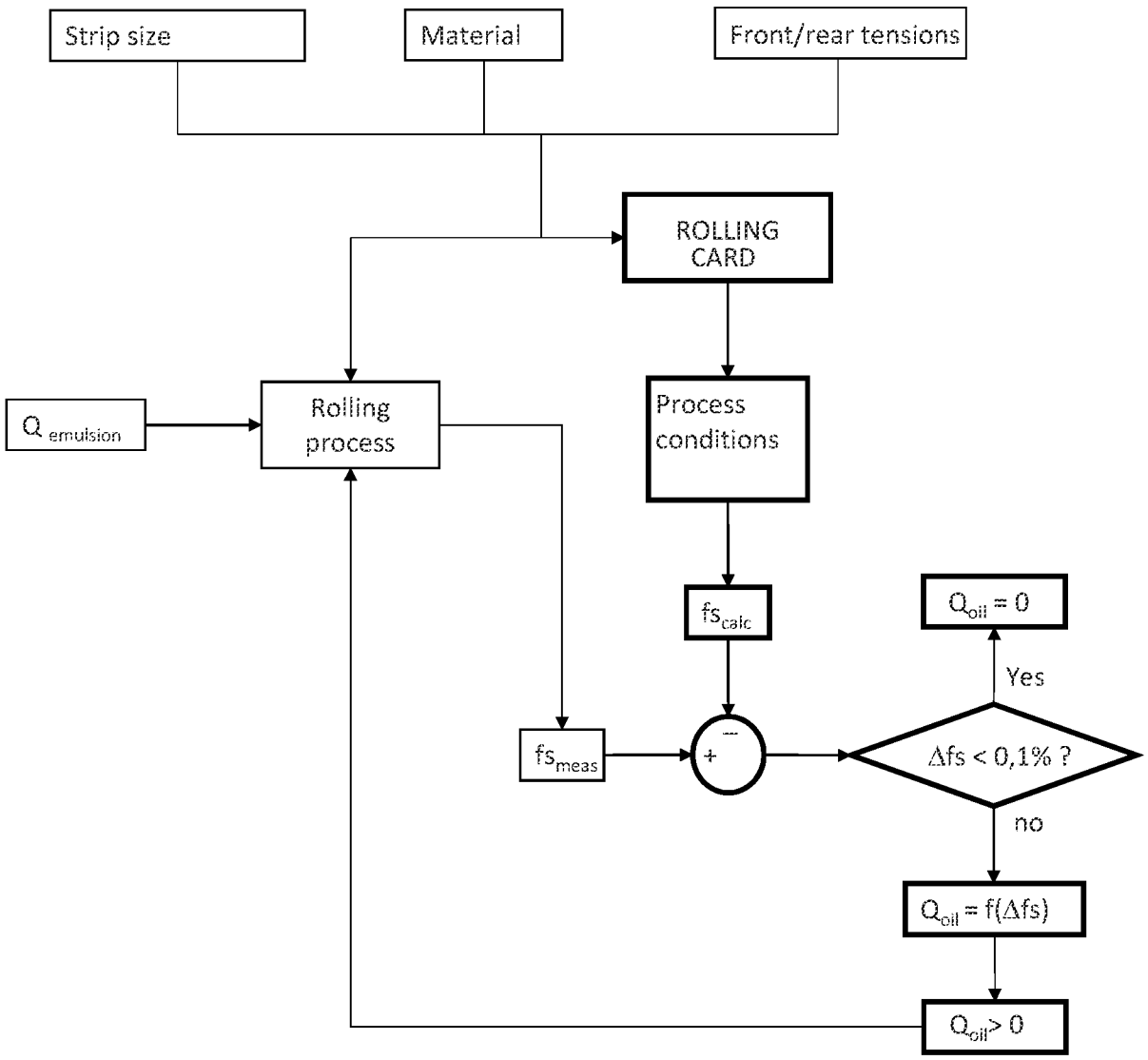
FIG. 1 depicts a flow chart related to a dynamic control system of the layer of lubricant on a product being rolled.

The rolling process of the present invention, for rolling products made of aluminum or aluminum alloys, provides for the aluminum product, e.g. a strip, to cross at least one rolling stand 1, thus producing a rolled product, and for a lubricant to be applied to the product, close to said at least one rolling stand 1, by means of a plurality of first applying means 2, upstream of the rolling compartment considering the feeding direction of the product itself.

The lubricant advantageously comprises, or consists of, an emulsion of oil and water. Some additives can optionally be provided in the emulsion.

Moreover, when required, there is provided a dynamic correction of the amount of lubricant, applied immediately upstream of the at least one rolling stand, always considering the feeding direction of the product itself.

In particular, $\Delta v = v_s - v_r$ being the difference between the feeding speed $v_s$ of the rolled product, measured at the output of the at least one rolling stand 1, preferably immediately at the output of the rolling stand, and the peripheral speed $v_r$ of the working rolls 3 of said at least one rolling stand 1, measured during the rolling operation, and $\Delta v_0 = v_{s0} - v_{r0}$ being the design value of said difference, i.e. the difference between the theoretical feeding speed $v_{s0}$ of the rolled product exiting from the at least one rolling stand 1, preferably immediately at the output of the rolling stand, and the theoretical peripheral speed $v_{r0}$ of the working rolls 3 of said at least one rolling stand 1, each time the relation $[(\Delta v * v_{r0})/(v_r * \Delta v_0)] - 1 < L$, where L is equal to a value between 0,0005 and 0,002, is not met, an application of only oil to the aluminum product advantageously is provided, upstream of the at least one rolling stand considering the product feeding direction, by a plurality of second applying means 6, until said relation is met again.

Preferably, the oil applied for the dynamic correction of the amount of lubricant so as to keep constant the thin film of lubricant, i.e. the thin gap occupied by the lubricant comprised between the surface of the strip and the surface of the working roll, is the same oil used in the water-based emulsion.

Preferably, but not necessarily, the value of L can be equal to 0.001.

The feeding speed $v_s$ of the rolled product is measured, for example by means of first sensors 4, thus producing first data. By mere way of example, such first sensors 4 can be laser velocimeters, photocells or tachometric wheels.

The peripheral speed $v_r$ of the working rolls 3 is measured, for example by means of second sensors 5, thus producing second data. By mere way of example, such second sensors 5 can be encoders of the electric motor which moves the working rolls themselves. The measurement of the peripheral speed $v_r$ can preferably be obtained through the rotation speed of the motor which moves the working rolls while considering a possible reduction ratio between the transmission and the working rolls.

The feeding speed $v_s$ and the peripheral speed $v_r$ can substantially be continuously detected, for example every 5 to 15 ms, preferably every 10 ms.

The theoretical feeding speed $v_{s0}$ and the theoretical peripheral speed $v_{r0}$ are easily calculated in known manner by those skilled in the art, and for this reason, the calculation thereof is not herein described. Generally, starting from some initial design data, such as for example the thicknesses of the strip entering into and exiting from the rolling stand, the mechanical features of the material, the tensions applied to the strip, the theoretical feeding speed $v_{s0}$ and the theoretical peripheral speed $v_{r0}$, and therefore the expected forward slip and friction coefficient, are easily calculated. It is simply worth noting that the initial data are easy to be found and available on the rolling card which all manufacturers need to have in order to manage the plant.

A control system 20, preferably a closed-loop control system, receives the first data, i.e. the values of $v_s$, and the second data, i.e. the values of $v_r$; verifies if the aforesaid relation is met, and, if said relation is not met, temporarily actuates the plurality of second applying means 6 until the relation is met again.

The reception of the first data and second data and the verification of the relation to be met can substantially continuously be performed, for example every 5 to 15 ms, preferably every 10 ms.

To better explain the method of the aforesaid dynamic correction of the amount of lubricant, it is worth noting that the forward slip is the phenomenon whereby a product, preferably a strip, at the output of the rolling compartment, has a feeding speed $v_s$ which is greater than the peripheral speed $v_r$ of the working rolls.

The forward slip "fs" is defined as follows:

$$fs = \frac{v_s - v_r}{v_r} = \frac{\Delta v}{v_r}$$

Introducing the subscript "0" for the calculated (or theoretical) speeds, similarly the following is defined:

$$fs_0 = \frac{v_{s0} - v_{r0}}{v_{r0}} = \frac{\Delta v_0}{v_{r0}}$$

The control system therefore assesses the ratio:

$$\frac{fs - fs_0}{fs_0}.$$

As shown in the flow chart in FIG. 1, if this ratio is greater than a given threshold, fixed between 0.05% and 0.2%, for example at 0.1%, then the control system imparts a command to the second applying means 6 to apply an additional amount of oil. In essence, the deviation between measured quantities (without subscript) and calculated quantities (subscript "0") is to be kept at very low values. If, for example, the feeding speed of the strip detected is much greater than the calculated speed, it is probable that the thin film of lubricant is broken in certain areas of the rolling compartment and, accordingly, that there is the problematic working rolls-aluminum product contact. In order to remediate this undesired circumstance, the system introduces pure oil to reform the thin layer of lubricant. Such an application of pure oil is to be considered occasional (it could be performed in the transient steps) and short in duration with respect to the entire rolling process. It advantageously is performed in a few moments to avoid potentially dangerous circumstances. The application of pure oil lasts until the relation $[(\Delta v * v_{r0})/(v_r * \Delta v_0)]-1<L$ is met again.

The emulsion of oil and water preferably is contained in a first tank 7 which supplies the plurality of the first applying means 2, and in said first tank said emulsion optionally is mixed by means of at least one mixing device 21.

The following is a description of an embodiment of a rolling plant adapted to perform the above-described process.

Figure 2:
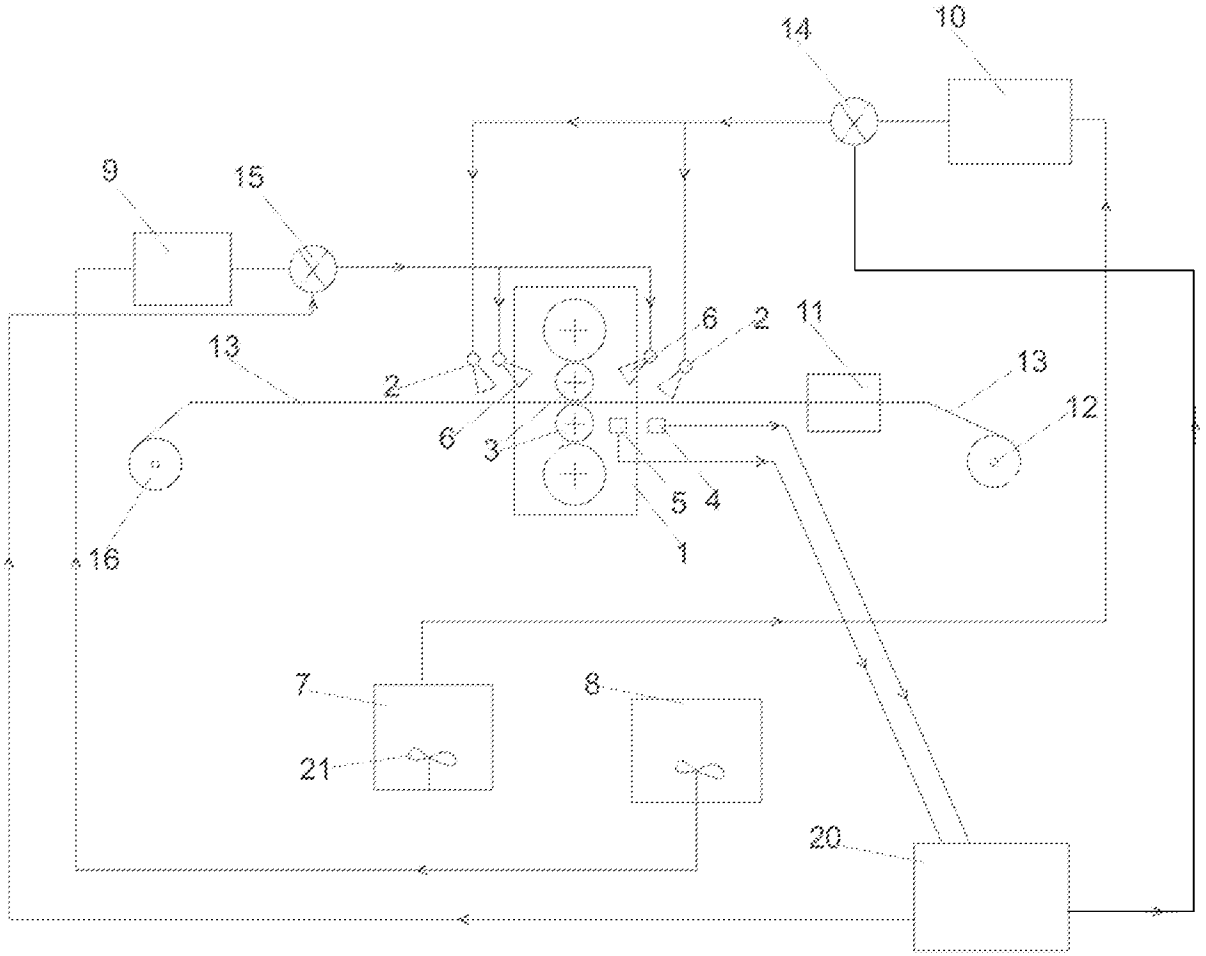
FIG. 2 depicts a diagram of a plant according to the invention.

With reference to FIG. 2, the rolling plant of products made of aluminum, or aluminum alloy, comprises:

- at least one rolling stand 1;
- a plurality of first applying means 2, arranged in proximity of said at least one rolling stand 1 and adapted to apply an emulsion of oil and water on the product, for example a strip 13.

Advantageously, the following are also provided:

- first sensors 4 for detecting the first data, i.e. the values of the feeding speed $v_s$ of the rolled strip exiting the at least one rolling stand 1;
- second sensors 5 for detecting the second data, i.e. the values of the peripheral speed $v_r$ of the working rolls 3 of said at least one rolling stand 1;
- a plurality of second applying means 6, arranged in proximity of said at least one rolling stand and adapted to apply only oil on the strip;
- a control system 20 adapted to
- receive said first data and said second data,
- calculate the difference $\Delta v = v_s - v_r$,
- verify if the relation $[(\Delta v * v_{r0})/(v_r * \Delta v_0)]-1<L$ is met, L being equal to a value between 0,0005 and 0.002,
- and, if said relation is not met, actuate said plurality of the second applying means 6.

Optionally, a first tank 7 contains the emulsion and supplies the plurality of the first applying means 2, preferably by means of a first dosing device 10 arranged between tank 7 and applying means 2.

A second tank 8 can also be provided, which contains only oil and, when requested by the control system, supplies the plurality of the second applying means 6, optionally by means of a second dosing device 9 arranged between tank 8 and applying means 6.

At least one mixing device 21 can be provided inside the tank 7 and/or inside the tank 8.

Preferably, at least one solenoid valve 14 is provided between the emulsion tank 7 and the applying means 2, or between the dosing device 10 and the applying means 2.

Similarly, at least one solenoid valve 15 can be provided between the oil tank 8 and the applying means 6, or between the dosing device 9 and the applying means 6.

The solenoid valve 15 and/or the solenoid valve 14 are controlled by the aforesaid control system 20.

The oil applying means 6 optionally can always be loaded with oil so that, when actuated by the control system 20 through the solenoid valve 15, they apply a predetermined amount of oil.

In an advantageous variant drying means 11 are provided, placed downstream of the at least one rolling stand 1, considering the product feeding direction, and upstream of a winding reel 12. Such drying means 11 are adapted to remove water from the rolled product. For example, at least one drying device of the CJD (Confined Jet Dryer) type can be used, which is configured to expel at least one compressed air jet in direction which is opposite to the feeding direction of the aluminum product.

Figure 3:
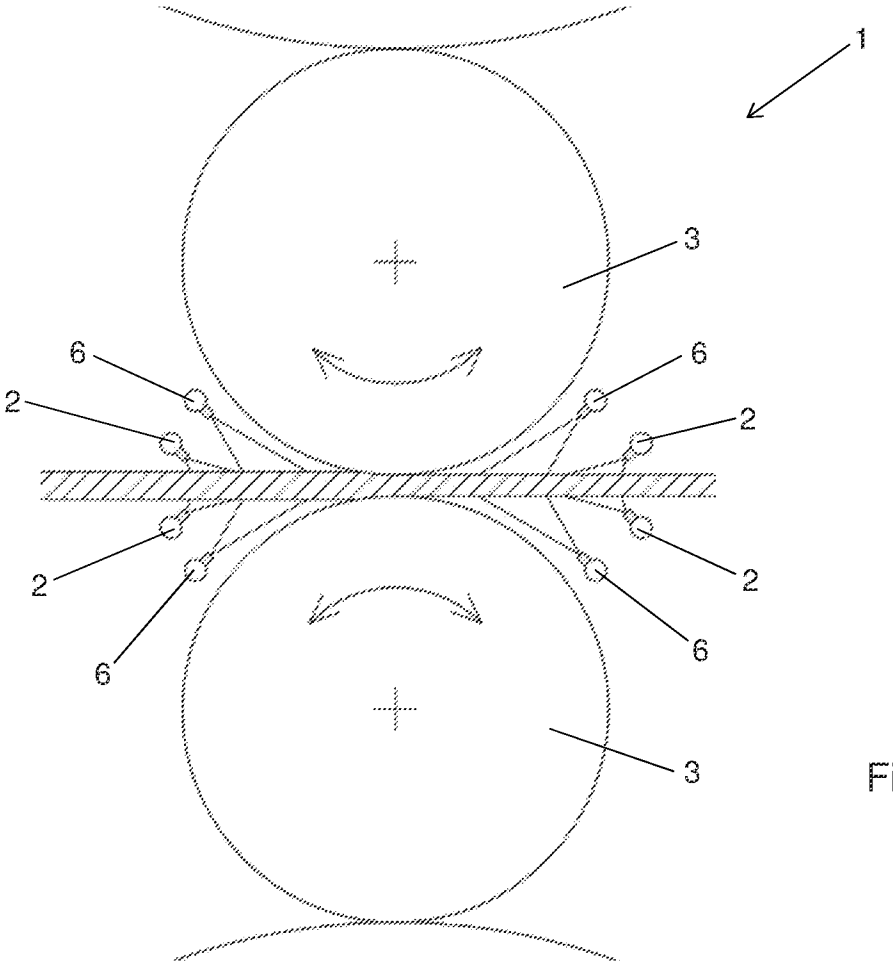
FIG. 3 depicts a first embodiment of part of the plant according to the invention.

In the case of a single rolling stand 1, this advantageously can be a reversible stand arranged between two reels 16, 12 which perform the task of unwinding or winding, respectively, the product according to the feeding direction of the product being rolled. In this case, the applying means 2 and the applying means 6 are arranged at both sides of the rolling stand 1 along the product feeding direction, preferably both above and below the product feeding plane (FIG. 3). The drying means 11 can be arranged between each reel 16, 12 and the rolling stand 1.

If the rolling stand 1 were to operate in only one direction, the applying means 2 and the applying means 6 would be arranged only at the input side of the aluminum product into the rolling stand 1, preferably both above and below the product feeding plane. In this case, the drying means 11 would only be arranged between the rolling stand 1 and the winding reel 12, the rolling stand being arranged between the unwinding reel 16 and the winding reel 12.

Figure 4:
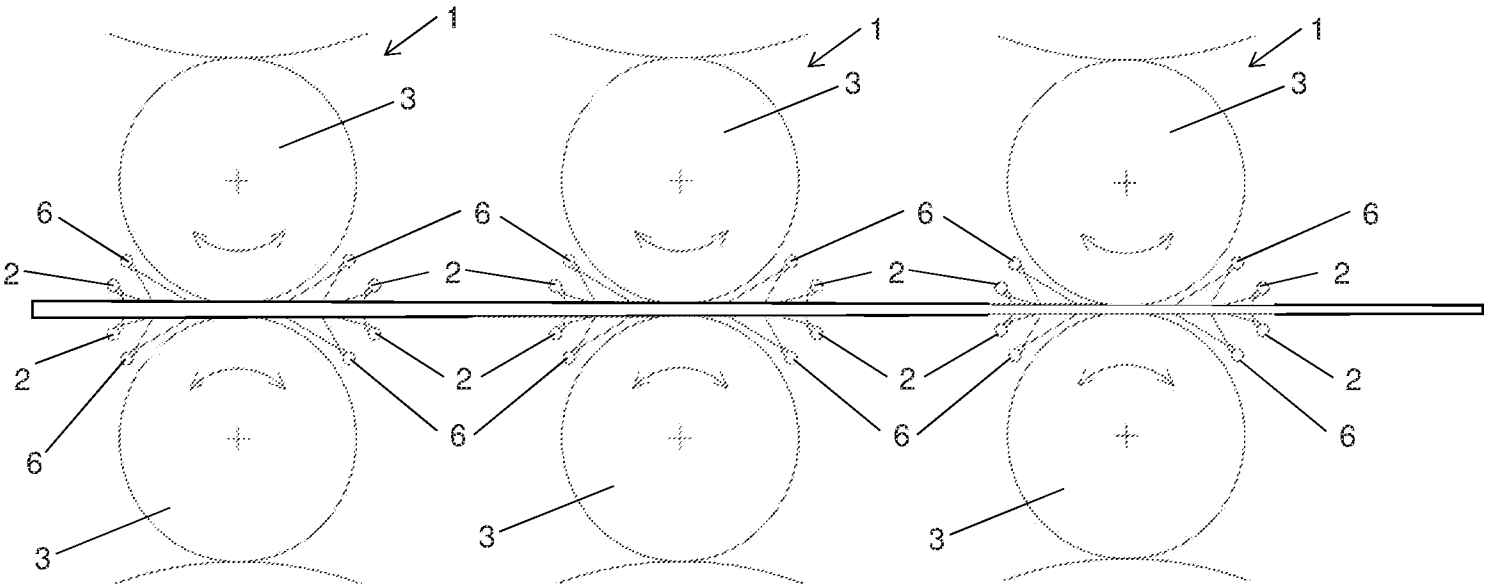
FIG. 4 depicts a second embodiment of part of the plant according to the invention.

Similarly, if at least two rolling stands 1 were provided, placed one after the other, a configuration known as a "tandem mill", both the applying means 2 and the applying means 6 would be arranged only at the product input side of each rolling stand, preferably both above and below the product feeding plane. Instead in the variant in FIG. 4, a plurality of reversible rolling stands 1 are provided, whereby here the applying means 2 and the applying means 6 are arranged at both sides of each rolling stand 1 along the product feeding direction, preferably both above and below the product feeding plane (FIG. 4).

More generally, the control system 20 can indifferently be applied to "four" stands (also known as 4-Hi), "six" stands (6-Hi) and cluster stands ("Sendzimir") in 12- or 20-roll configuration (12-Hi and 20-Hi, respectively). While the first two types of rolling stands can be grouped, giving rise to tandem mills, the cluster stands are always individual stands.

In some embodiments of the invention, it is preferable for the applying means 6 to be arranged in a position which is proximal to the working rolls 3 of the rolling stand 1 but distal from the product feeding plane with respect to the applying means 2. Similarly, the applying means 2 are arranged in a position which is distal from the working rolls 3 but proximal to the product feeding plane with respect to the injection means 6.

For example, the distance between the applying means 6 and the vertical plane containing the rotation axes of the working rolls of the corresponding rolling stand is between D/4 and 3D, preferably between D/3 and 2D, D being the diameter of the working rolls 3; while the distance between said applying means 6 and the product feeding plane is between D/10 and D/2, preferably between D/5 and D/3.

Instead, the distance between the applying means 2 and the vertical plane containing the rotation axes of the working rolls of the corresponding rolling stand is between D/3 and 4D, preferably between D/2 and 3D; while the distance between said applying means 2 and the product feeding plane is between D/10 and D/2, preferably between D/8 and D/4.

In other embodiments, however, the applying means 6 are arranged in a position which is distal from the working rolls 3 of the rolling stand 1 but proximal to the product feeding plane, while the applying means 2 are arranged in a position which is proximal to the working rolls 3 but distal from the product feeding plane. Here, the aforesaid ranges of distances mentioned in the preceding paragraph can be considered inverted.

By way of example, both the plurality of the applying means 2 and the plurality of the applying means 6 comprise, or consist of, injection devices, for example comprise rows of nozzles which preferably extend along the width of the aluminum product, i.e. transversely to the product feeding plane.

The invention claimed is:

1. A process of cold rolling a product made of aluminum; or aluminum alloys; through at least one rolling stand, wherein a lubricant is applied to the product in proximity of said at least one rolling stand by means of a plurality of first applying means, said lubricant comprising an emulsion of oil and water;

the process comprising:

wherein $\Delta v = v.sub.s - v.sub.r$ is a difference between the feeding speed, v.sub.s, of the rolled product; measured at an output of the at least one rolling stand, and the peripheral speed, v.sub.r, of the working rolls of said at least one rolling stand, measured during a rolling operation, and $\Delta v.sub.0 = v.sub.s0 - v.sub.r0$ is a theoretical value of said difference, each time the relation $[(\Delta v * v.sub.r0)/(v.sub.r * \Delta v.sub.0)] - 1 < L$, where L is equal to a value between 0.0005 and 0.002, is not met, providing only oil to the aluminum product upstream of said at least one rolling stand in a product feeding direction by a plurality of second applying means until said relation is met again.

2. The process according to claim 1, wherein L=0.001.

3. The process according to claim 1, wherein said feeding speed, v.sub.s, of the rolled product is continuously measured by means of first sensors thus generating first data; wherein said peripheral speed, v.sub.r, of the working rolls is continuously measured by means of second sensors thus generating second data; and wherein a control system continuously receives said first data and said second data, determines whether said relation is met, and, if said relation is not met, actuates the plurality of second applying means.

4. The process according to claim 1, wherein said emulsion of oil and water is contained in a first tank which supplies the plurality of first applying means and wherein said emulsion is mixed.

5. A cold rolling plant for rolling aluminum or aluminum alloy comprising: at least one rolling stand; a plurality of first applying means arranged close to said at least one rolling stand and adapted to inject an emulsion of oil and water on the product; first sensors for detecting first data, said first data being values of the feeding speed, v.sub.s, of the rolled product exiting the at least one rolling stand; second sensors for detecting second data, said second data being values of the peripheral speed, v.sub.r, of the working rolls of said at least one rolling stand; a plurality of second applying means arranged close to said at least one rolling stand and adapted to inject only oil on the product; a control system adapted to: receive said first data and said second data, calculate the difference Δv=v.sub.s-v.sub.r, determine if the relation [(Δv*v.sub.r0)/(v.sub.r*Δv.sub.0)]−1<L is met, Δv.sub.0=v.sub.s0-v.sub.r0 being the theoretical value of said difference and L being equal to a value between 0.0005 and 0.002, and, if said relation is not met, actuate said plurality of second applying means.

6. The plant according to claim 5, wherein there are provided: a first tank adapted to contain said emulsion and supply the plurality of first applying means by means of a first dosing device; a second tank adapted to contain only oil and supply the plurality of second applying means by a second dosing device.

7. The plant according to claim 5, wherein drying means are provided, placed downstream of the at least one rolling stand, considering the product feeding direction; and upstream of a winding reel and adapted to remove water from the rolled product.

8. The plant according to claim 5, wherein the at least one rolling stand is reversible rolling stands, both said plurality of first applying means and said plurality of second applying means are arranged at both sides of said rolling stand along the product feeding direction both above and below a product feeding plane.

9. The plant according to of claim 5, wherein the at least one rolling stand is at least two rolling stands, placed one after the other, both said plurality of first applying means and said plurality of second applying means are arranged only at product input side of each rolling stand both above and below a product feeding plane.

10. The plant according to claim 5, wherein said plurality of second applying means are arranged in a position which is proximal to the working rolls of the rolling stand but is distal from a product feeding plane, while said first applying means are arranged in a position which is distal from the working rolls but is proximal to the product feeding plane.

11. The plant according to claim 5, wherein said plurality of second applying means are arranged in a position which is distal from the working rolls of the rolling stand but is proximal to a product feeding plane, while said first applying means are arranged in a position which is proximal to the working rolls but is distal from the product feeding plane.

* * * * *